United States Patent [19]

Keller

[11] Patent Number: 4,907,984

[45] Date of Patent: Mar. 13, 1990

[54] TEMPORARY SECURING DEVICE FOR ELECTRIC CORDS

[76] Inventor: Lee S. Keller, 1015 S. Clementine St., Oceanside, Calif. 92054

[21] Appl. No.: 311,767

[22] Filed: Feb. 17, 1989

[51] Int. Cl.[4] ..... H01R 13/62

[52] U.S. Cl. ..... 439/369; 24/306; 24/573; 439/371

[58] Field of Search ..... 439/366, 367, 368, 369, 439/370, 371, 373; 24/163 R, 305, 306, 573, 633

[56] References Cited

U.S. PATENT DOCUMENTS

| | | | |
|---|---|---|---|
| 1,455,545 | 5/1923 | Monahan | 24/163 R |
| 3,014,256 | 12/1961 | Derrickson et al. | 24/163 R |
| 3,855,637 | 12/1974 | Luger | 24/163 R |
| 4,097,105 | 6/1978 | Zumwalt | 439/369 |
| 4,690,476 | 9/1987 | Morgenrath | 439/502 |
| 4,702,540 | 10/1987 | Siemon | 439/371 |

FOREIGN PATENT DOCUMENTS

| | | | |
|---|---|---|---|
| 2083543 | 3/1982 | United Kingdom | 24/305 |

*Primary Examiner*—Neil Abrams
*Assistant Examiner*—Khiem Nguyen
*Attorney, Agent, or Firm*—John J. Murphey

[57] ABSTRACT

A device for temporarily securing the engagement of joined end plugs of end-to-end interconnected first and second electrical cords that includes first and second removable, flexible, electrically insulated harnesses, for encircling each of the electric cords adjacent the joined end plugs, each harness having at least two bands of terminal length extending toward the plugs wherein the terminal ends of the straps are adapted to thread through cinches or joinable cinch subcomponents for pulling the harnesses tightly into temporary interconnection.

17 Claims, 2 Drawing Sheets

TEMPORARY SECURING DEVICE FOR ELECTRIC CORDS

BACKGROUND OF THE INVENTION

1. Field of the Invention

This invention pertains to the field of safety equipment. More particularly, it pertains to the field of electrical safety equipment namely for temporarily securing together end-to-end interconnected electrical cords to withstand the rigors of pulling and twisting of the cords when used to power equipment, lighting, computers, etc.

2. Description of the Prior Art

Everyone, during some part of his or her lifetime, has experienced the problem of having end-to-end interconnected electrical extension cords pull apart at the plug interface. When connecting together electrical extension cords to operate hedge trimmers or to extend a light out to the garage or otherwise, the slightest tug on the cords will cause parting of the interconnected plugs. A popular method of preventing this is to twist the mated ends together into a half-knot. However, such a cure reduces the overall length of the cord while often causing significant damage to the prongs of the plug when the cords are pulled and further may put a twist in the line that could split or damage the insulating cover over the cord. Some effort has been made to include apertures in the respective plugs for receipt therein of a U-shaped pin or other type of locking device. For the most part, these solutions cause more problems than they cure because the pins are often made of metal and, over time, can work their way through the rubber or plastic plug coating up against the metallic prongs in the plugs causing shorting and possibly fire or electrocution. Even partial disconnection of the plugs during stretching causes problems. For instance, in end-to-end connected computer cables, such slight loosening may cause static in the lines and interrupt the transmission of bits and bytes of digital information from one computer to another or to a printer. Further, where the cords are used near metal or flammable liquids, slight parting of the plugs may expose the metal prongs to extraneous metal edges that could cause shorting, electrocution, burn out of motors and fire.

The prior art has attempted to solve these problems by using harnesses secured about the electric cord plugs having means to join them together Specifically, U.S. Pat. No. 4,690,476 calls for harnesses riveted about each cord adjacent its respective end plugs, straps extending from the harnesses toward the plugs, one set of straps having metal rings and another having a set of elongated straps. The straps are looped through the rings and pulled back on themselves and joined together through the use of a set of hook and loop fasteners that are attached to the elongated straps.

This prior art attempt has significant disadvantages that have prevented its acceptance. For instance, the riveted collars lock the harnesses to only one line and prevent their use on any other cord. Accordingly, each set of harnesses represents an expense to be doubled (one at each end of the cord) and added to the cost of the cord. Should two sets of cords wind up with harnesses containing rings, then the cords could not be connected using those harnesses. In addition, the ring on the harness is made of metal and may cause shorting of partially disconnected plugs to start fires, damage equipment or electrocute the user. Further, the hook and loop fasteners may fill with dirt, mud and debris during use outdoors or in dusty areas and such will render them useless.

Still further, the slightest exposure to mud and dirt will severely weaken the hoop and loop fasteners and cause them to part when the cords are placed under any significant tension. Finally, these prior art devices are irreversibly attached to the ends of the cords so that washing them, to remove dirt, mud and/or grease, entails exposing the cord and plug or receptacle to liquids such as water or cleaning solutions thereby reducing the insulation value of the cord and conductor coverings.

Accordingly, there is still the need in the electrical industry for a small, inexpensive cord connector to be used as a temporary securing device for end-to-end interconnected electrical cords that may be removed from the cord and used with other cords where desired, that will be useful on different diameter cords, that contain no metal or other electrically conducting medium so as not to cause fires, personal injury or other damage, that will operate in environments of dirt, mud and dust without jamming or otherwise becoming useless and further that is inexpensive.

SUMMARY OF THE INVENTION

This invention is a device for temporarily securing the engagement of joined plug ends of end-to-end interconnected first and second electrical cords that solves all of the aforesaid problems. It involves the use of two electrically insulated harnesses, one for use at each end of the electric cord. One harness includes a removable, first adjustable collar means for encircling the first electric cord adjacent its plug end and has at least two bands of terminal length extending from the collar toward the plug end that are each terminated with an electrically insulated adjustable cinch. The other harness includes a removable, second adjustable collar means for encircling the second electric cord adjacent its plug end, and has at least two straps of terminal length extending from the collar toward the cinches, each being of a length sufficient to be threaded into and back out of the cinches when the cords are interconnected. The free ends of the straps are adapted to be threaded through the cinches and back against itself and thereafter pulled tight to draw the harnesses toward each other to secure the plug ends. The collar means include a strap for encircling the respective electric cord and a fastener such as a buckle, for tightening the strap about the cord, or a set of loop and hook fasteners, for engagement of the strap about the cord, to keep it in tight encirclement thereabout while usable with a wide range of cord diameters.

The device is made of non-electrically conducting plastic such as nylon that is both water resistant and electrically insulating to prevent transmission of electrical energy and the other hazards previously described. In addition, the loop and hook fasteners are arranged to be fully engaged throughout their entire length to prevent the introduction of dirt, mud and dust that would otherwise fill them and render them unusable. Further, the collar means are not only adjustable but removable so that the harnesses may be moved from one set of cords to another thereby making them far more versatile than other devices of the prior art. As this device is readily removable from the cord, it is easy to clean with soap and water or other cleaning solvent without exposing the cord to such liquids.

Accordingly, the main object of this invention is a portable device for temporarily securing the engagement of joined plugs of end-to-end interconnecting first and second electrical cords that is totallY electrically insulated. Further objects include a device that is adjustable to fit various diameter cords, usable with a wide variety of plug configurations, fully adjustable to accommodate different depths of plugs, designed to be free of adverse effects of mud, dirt and dust, to be useful over and over again, easily removable for cleaning apart from the cord, transportable between different plugs and their respective cords, and made of inexpensive materials. These and other objects of the invention may be gleaned from a fair reading of the specification that follows taken along with the drawings appended hereto. The scope of protection sought by the inventor may be obtained from a fair reading of the claims that conclude this specification.

DESCRIPTION OF THE PREFERRED EMBODIMENT

Figure 1:
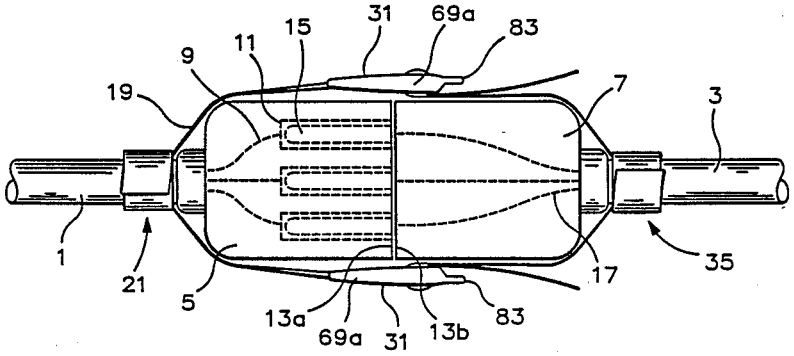
FIG. 1 is an illustrative view showing the invention used to temporarily secure the plugs of typically end-to-end interconnected electrical cords.

This invention is applied to electric cords that are joined at their plug ends in end-to-end configuration. One such configuration is shown in FIG. 1 where a pair of first and second electric cords, and 3 respectively, each have plugs 5 and 7 attached respectively to the ends thereof. Cord 1 contains a plurality of electrical conductor wires 9 that are attached to elongated metal sleeves 11 in plug 5 that extend inward from a plug interface surface 13a. A plurality of metal prongs 15 extending outward from plug 7 at its interface surface 13b are connected to the electrical conductors 17 in second cord 3. When cords 1 and 3 are interconnected in end-to-end fashion, prongs 15 are inserted in sleeves 11 as is already known in the art.

Figure 2:
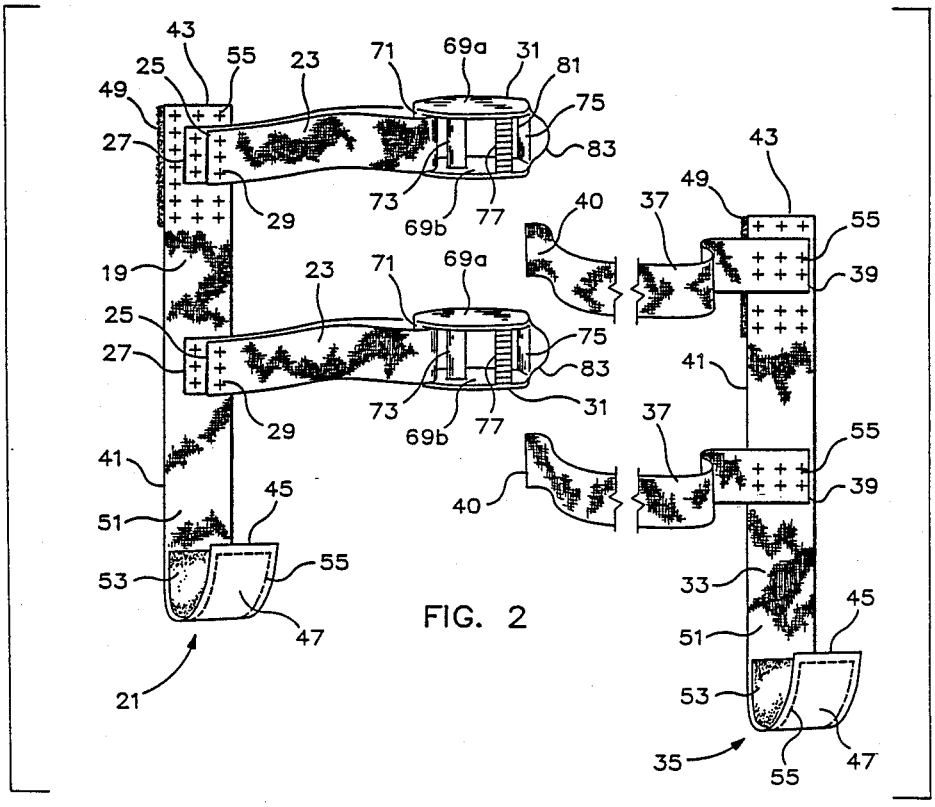
FIG. 2 is an exploded view of one embodiment of the two harnesses making up the invention.

Referring to FIG. 2, the device of this invention may be seen to comprise a first flexible, electrically insulated harness 19 that includes a first adjustable collar means 21 for temporarily encircling first electric cord 1 near its respective plug 5. At least two, but possible more, flexible bands 23, each bounded by terminal ends 25 and 27, are attached to first collar means 19, such as by sewn stitches 29, and have attached thereto an electrically insulated adjustable cinch 31. As shown in FIG. 2, both terminal ends 25 and 27 of bands 23 are attached directly to collar means 21, said bands being looped through one end of cinches 31. An alternate configuration, fully contemplated in this invention, is to have one terminal end 25 attached to collar means 21 and other end 27 attached to cinch 31.

Generally, two straps 23 are sufficient to secure the harnessed end plugs of cords 1 and 5 together. There are, however, occasions when, due to the diameter of cords 1 and/or 3 or the size of plugs 5 and/or 7, more than two straps are needed. While only two straps are shown in the drawings, more are fully contemplated in this invention. Further, the straps are most desirably spaced equidistant about their respective cords to provide maximum overall Support to the joined plugs.

A second harness 33 is provided having a second adjustable collar means shown at 35 for temporarily encircling second electrical cord 3. At least two, but possibly more, straps 37 of terminal length are attached at one end 39 to adjustable collar means 35 with the other strap end 40 extending toward second cord plug 7 and cinches 31. Straps 37 are of a length sufficient to be threaded through cinches 31 as hereinafter described when plugs 5 and 7 are interconnected. Generally, two straps 23 are sufficient to secure the harnessed end plugs of cords 1 and 5 together. There are, however, occasions when, due to the diameter of cords 1 and/or 3 or the size of plugs 5 and/or 7, more than two straps are needed. While only two straps are shown in the drawings, more are fully contemplated in this invention. Further, the straps are most desirably spaced equidistant about their respective cords to provide maximum overall support to the joined plugs.

As shown in FIG. 2, collar means 21 and 35 each comprise a belt 41 having terminal ends 43 and 45 for encircling the respective electric cord. Attached to belt 41 on one side 47 thereof near end 43 is attached a short length 49 of one part of a hook and loop fastener set such as Velcro (trademark). On the other side 51 of belt 41 at or near end 45 is attached another length 53 of the other part of the hook and loop fastener set. Attachment of lengths 49 and 53 to belt 41 may be by many means such as glue or rivets or by stitches 55 as shown. When harnesses 19 and 33 are to be attached to their respective electric cords, belts 41 are placed around the respective cords and lengths 49 and 53 of each hook and loop fastener set intertangled to engage belts 41 tightly about the cords to hold the harness tightly thereto. Because hook and loop fastener set lengths 49 and 53 are attached to the belts near belt ends 43 and 45, the fastener set becomes fully engaged about cords 1 and 3 thereby shielding the hooks and loops from damage by dust, mud, dirt and other debris.

Figure 3:
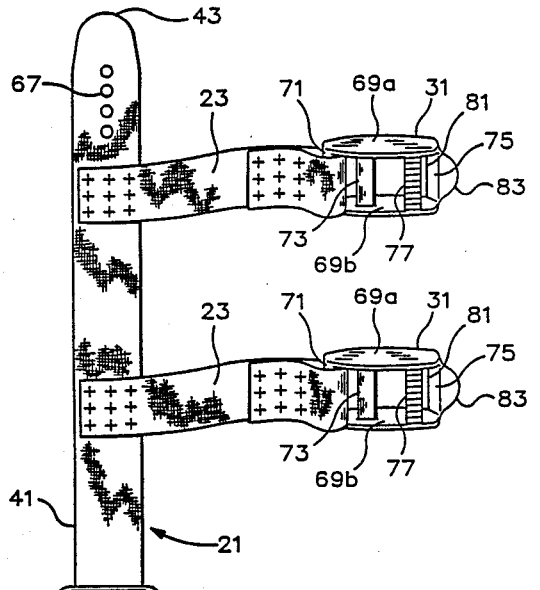
FIG. 3 is a perspective view of another embodiment of the harness of this invention; and, FIG. 4 is a sectional side view of a typical cinch usable in this invention.

As shown in FIG. 3, first and second collar means 21 (and 35 as well) may also include a fastener such as buckle 57 at belt end 45 having an enclosed frame 59 and a center divider bar 61 attached to belt end 45 by stitches 63. A buckle pin 65 is pivotally attached to center bar 61 for penetration into one of a series of apertures 67 formed or punched in belt 41 near end 43 when belt 41 is wrapped around the cord and belt end 43 threaded through frame 59 over center divider bar 61. This embodiment is useful on large diameter cords. Such an embodiment presents no electrical hazard because the buckle, (preferably made of plastic but even if made of metal) is located behind the plug, well away from sleeves 11 and prongs 15.

Figure 4:
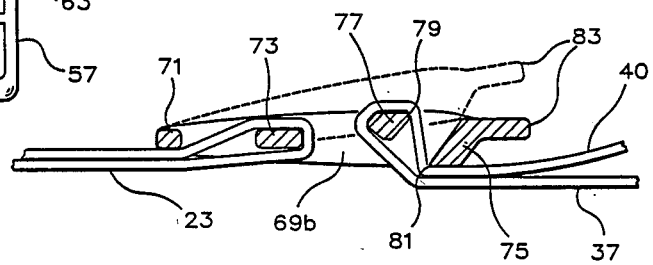

As shown in FIGS. 2 and 4, adjustable cinch 31 comprises a pair of elongated opposed sidewalls 69a and 69b held in spaced-apart relation by a plurality of fixed cross-arms 71, 73 and 75 spaced therealong and spanning therebetween Band 23 is connected to cinch 31 at cross-arm 71. A centrally located cinch-bar 77 is positioned inboard of cross-arm 75, spanning sidewalls 69a and 69b, and arranged normal or perpendicular to the long axis x—x of straps 37. A pair of sharp edges 79 and 81 are respectively formed on cross-arm 75 and cinch bar 77 and arranged in spaced-apart, facing, off-set relationship so that when strap 37 is inserted in cinch 31, between cross-arm 75 and cinch bar 77 and looped about cinch-bar 77 and threaded back around cross-arm 75 to double over strap 37 on itself, strap 37 is caused to pass over respective sharp edges 79 and 81 and form a self-locking combination or configuration.

As shown in FIG. 1, first harness 19 is attached to first electric cord 1 by having its adjustable collar means 21, such as belt 41, inter-fastened about cord 1 through Velcro fastener strips 49 and 53 or through buckle 57 and apertures 67. Second harness 33 is likewise attached about second electric cord 3 with Velcro strips or a buckle. Straps 37 are then pulled toward cinches 31 and each strap end 40 inserted in cinch 31 looped about cinch-bar 77, over its sharp edge 79 and back down under sharp edge 81, on cross-arm 75 and laid adjacent strap S. After both straps 37 are attached to cinches 31, the free ends 40 are pulled to tighten straps 37 and bands 23 to draw said harnesses toward each other thereby temporarily securing the engagement of joined end plugs 5 and 7.

On cross-arm 75, outboard of sharp edge 81 is formed a protruding release tab 83. As shown in dotted outline in FIG. 4, the purpose of tab 83 is to release straps 37 from their locked configuration by pivoting cinch 31 about cross-arm 71 so as to rotate sharp edges 79 and 81 from their position relative to doubled-over strap 37 and allow strap end 40 to slide along or relative to strap 37 and loosen its grip. Straps 37 may then be pulled free of cinches 31 and cords 1 and 3 disconnected. Harnesses 19 and 33 may then be removed from cords 1 and 3 or continued to be used thereon and merely joined with other harnesses. Should two harnesses wind up with cinches facing each other, one is merely removed and another with straps substituted therein.

Figure 5:
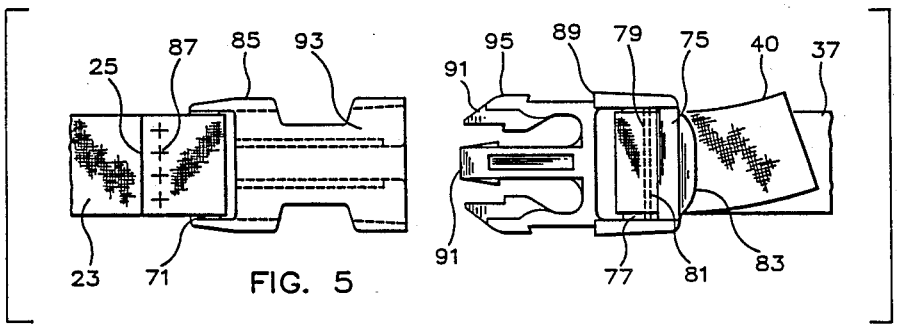
FIG. 5 is an illustrative view of another embodiment of this invention showing the clips to be made in interlockable parts.

Cinches 31 may also be made in two, interconnectable parts as shown in FIG. 5. As shown, belt 23 is attached to one separable cinch portion 85 by looping belt end 25 around cross-arm 71 and securing it with stitches 8. Belt 37 is attached to the other separable cinch portion 89 by looping belt end 40 around cinch bar 77, over sharp edge 81, and under cross arm 75 and release tab 83 back onto itself. The two interconnectable parts of cinch 31 are formed of male prongs 91 that are adaptable to be inserted into female sleeves 93 and held therein by a series of interlocking ridges (not shown). The portions are releasable from each other by depressing the outside edges 95 of prongs 91 and pulling the portions apart. This construction is further detailed in U.S. Pat. 4,17I,555. Other releasably interconnectable cinches that contain both male prongs 91 and female sleeves 93 in the same cinch part are usuable and fully contemplated in this invention.

It is preferred that cinches 31 be made of non-conducting materials such as glass filled epoxy resin or other thermosetting or thermoplastic polymers. Further, it is preferred that bands 23, straps 37, belts 41 and the short lengths of hook and loop fasteners all be made out of a plastic material such as polypropylene or nylon which not only possesses a high dielectric constant (i.e., is a good electrical insulator) but is free from adverse effects of water, mud and dirt and will operate properly in those environments

What is claimed is:

1. A device for temporarily securing the engagement of joined end plugs of end-to-end interconnected first and second electric cords, comprising:

(a) a first removable, flexible, electrically insulated harness, including first adjustable collar means for encircling the first electric cord, adjacent its end plug, and having at least two bands, of terminal length extending from said collar means toward the plug, each having attached thereto an electrically insulated cinch wherein each cinch includes a pair of elongated opposed side walls held in spaced-apart relation by a plurality of fixed, spaced-apart cross-arms spanning therebetween, a cinch bar interior of said cross-arms, spanning said sidewalls and arranged normal to the long axis of a strap to be introduced thereinto and a pair of sharp edges formed respectively on said cinch bar and an adjacent cross-arm in spaced-apart, facing relationship so that when said strap in inserted into said cinch, looped about said cinch bar and threaded back around said adjacent cross-arm on which said sharp edge is formed, said strap passes over said sharp edges and forms a self-locking configuration in said cinch when said terminal end of said strap is pulled tight; and, (b) a second removable, flexible, electrically insulated harness including second adjustable collar means for encircling the second electric cord, adjacent its end plug, and having at least two elongated straps extending from said collar means toward said cinches, each strap of a length sufficient to be threaded into and back out of said cinches when the plugs are interconnected;

(c) wherein a clasping action is developed in said cinch, independent of said straps and bands and the surfaces thereof, to secured said joined end plugs.

2. The device of claim 1 wherein said bands and said straps are arranged equidistant about the cord when said harnesses are attached to the cords.

3. The device of claim 1 wherein said first collar means includes a belt defined by opposed, spaced-apart ends and opposed flat sides for encircling the respective electric cord and having attached to one said side thereof a length of one part of a hook and loop fastener set and having attached to the other said side thereof a length of the other part of said set, each said length having a portion near said spaced-apart ends, for interengagement to secure said harness about the cord.

4. The device of claim 1 wherein said second collar means includes a belt defined by opposed, spaced-apart ends and opposed flat sides for encircling the respective electric cord and having attached to one said side thereof a length of one part of a hook and loop fastener set and having attached to the other said side thereof a length of the other part of said set, each said length having a portion near said spaced-apart ends, for interengagement to secure said harness about the cord.

5. The device of claim 1 wherein said first collar means includes a belt, terminated at opposed ends, having a buckle at one end including a frame and a lock pin through which said other belt end may be adjustably threaded to tighten said collar about the cord.

6. The device of claim 1 wherein said second collar means includes a belt, terminated at opposed ends, having a buckle at one end including a frame and a buckle pin through which said other belt end may be adjustably threaded to tighten said collar about the cord.

7. The device of claim 1 wherein said straps and bands are constructed of woven nylon.

8. The device of claim 1 wherein said cinches are constructed of dielectric plastic.

9. The device of claim 1 further including a protruding release tab for lifting to pivot said cinch, and rotating said pair of sharp edges out of interlocking relationship to release said harnesses from each other.

10. A device for temporarily securing the engagement of joined end plugs of end-to-end interconnected first and second electric cords, comprising:

(a) a first removable, flexible, electrically insulated harness, including first adjustable collar means for encircling the first electric cord, adjacent its end plug, and having at least two bands of terminal length extending from said collar means toward the plug, each having attached thereto a first portion of an electrically insulated, adjustable, interconnectable cinch; and, (b) a second removable, flexible, electrically insulated harness including second adjustable collar means for encircling the second electric cord, adjacent its end plug, and having at least two elongated straps extending from said collar means toward said first cinch portions, each having attached thereto a second portion of an electrically insulated, adjustable, interconnectable cinch;

(c) wherein each said cinch portion includes a pair of elongated opposed side walls held in spaced-apart relation by a plurality of fixed, spaced-apart cross-arms spanning therebetween, a cinch bar interior of said cross-arms, spanning said sidewalls and arranged normal to the long axis of said strap and a pair of sharp edges formed respectively on said cinch bar and an adjacent cross-arm in spaced-apart, facing relationship so that when said strap is inserted into said cinch, looped about said cinch bar and threaded back around said adjacent cross-arm on which said sharp edge is formed, said strap passes over said sharp edges and forms a self-locking configuration in said cinch portion when said strap is pulled tight;

(d) wherein said first and second portions of said interconnectable cinches are adapted to be adjusted along said bands and straps and thereafter interconnected into locking configuration to draw said harnesses toward each other to secure said joined end plugs.

11. The device of claim 10 wherein said straps and bands are constructed of woven nylon.

12. The device of claim 10 wherein said cinch portions are constructed of dielectric plastic.

13. The device of claim 10 wherein said bands and said straps are arranged equidistant about each cord when said harnesses are attached to the cords.

14. The device of claim 10 wherein said first collar means includes a belt defined by opposed, spaced-apart ends and opposed flat sides for encircling the respective electric cord and having attached to one said side thereof a length of one part of a hook and loop fastener set and having attached to the other said side thereof a length of the other part of said set, each said length having a portion near said spaced-apart ends, for interengagement to secure said harness about the cord.

15. The device of claim 10 wherein said second collar means includes a belt defined by opposed, spaced-apart ends and opposed flat sides for encircling the respective electric cord and having attached to one said side thereof a length of one part of a hook and loop fastener set and having attached to the other said side thereof a length of the other part of said set, each said length having a portion near said spaced-apart ends, for interengagement to secure said harness about the cord.

16. The device of claim 10 wherein said first collar means includes a belt, terminated at opposed ends, having a buckle at one end including a frame and a lock pin through which said other belt end may be adjustably threaded to tighten said collar about the cord.

17. The device of claim 10 wherein said second collar means includes a belt, terminated at opposed ends, having a buckle at one end including a frame and a buckle pin through which said other belt end may be adjustably threaded to tighten said collar about the cord.

* * * * *